US008117963B2

(12) United States Patent
Roth et al.

(10) Patent No.: US 8,117,963 B2
(45) Date of Patent: Feb. 21, 2012

(54) PRINTING SECURITY FEATURES

(75) Inventors: Joseph D. Roth, Springboro, OH (US); John Holz, Natick, MA (US)

(73) Assignee: NCR Corporation, Duluth, GA (US)

( * ) Notice: Subject to any disclaimer, the term of this patent is extended or adjusted under 35 U.S.C. 154(b) by 1004 days.

(21) Appl. No.: 11/961,428

(22) Filed: Dec. 20, 2007

(65) Prior Publication Data

US 2009/0158946 A1 Jun. 25, 2009

(51) Int. Cl.
*B41F 9/02* (2006.01)
*B41F 5/16* (2006.01)
*B41F 5/18* (2006.01)

(52) U.S. Cl. ..... 101/152; 101/181

(58) Field of Classification Search ..... 101/5, 6, 101/23, 151, 152, 171, 180, 181, 186, 189
See application file for complete search history.

(56) References Cited

U.S. PATENT DOCUMENTS 5,465,176 A * 11/1995 Bianco et al. ..... 359/567
6,109,172 A * 8/2000 Wyssmann ..... 101/115
7,147,453 B2 * 12/2006 Boegli ..... 425/363
2003/0121984 A1 * 7/2003 Pinchen et al. ..... 235/487

* cited by examiner

*Primary Examiner* — Ren Yan
*Assistant Examiner* — Marissa Ferguson Samreth
(74) *Attorney, Agent, or Firm* — Paul W. Martin; Michael Chan; Dana T. Hustins

(57) ABSTRACT

A printing machine for printing security features onto a web. The machine has a first printing cylinder defining a first circumference and carrying a first number (m) of rows of first image elements, each adjacent row of first image elements having a first circumferential separation. The machine also has a second printing cylinder defining a second circumference, different to the first circumference, and carrying a second number (n) of rows of second image elements, different to the first number (m) of rows, where each adjacent row of second image elements has the same first circumferential separation as adjacent rows of first image elements. The printing cylinders are operable to print the first and second image elements in registration on a web so that composite security features are created on the web from the first and second image elements.

3 Claims, 5 Drawing Sheets

FIG. 3
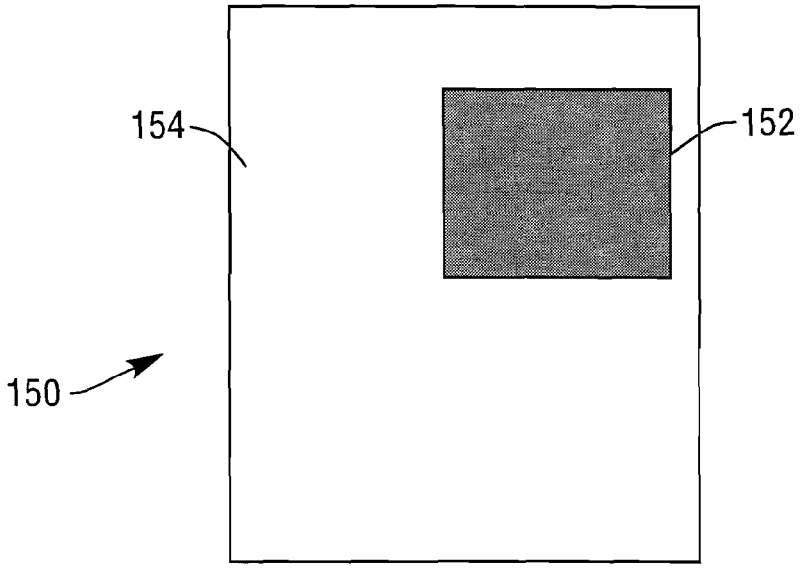
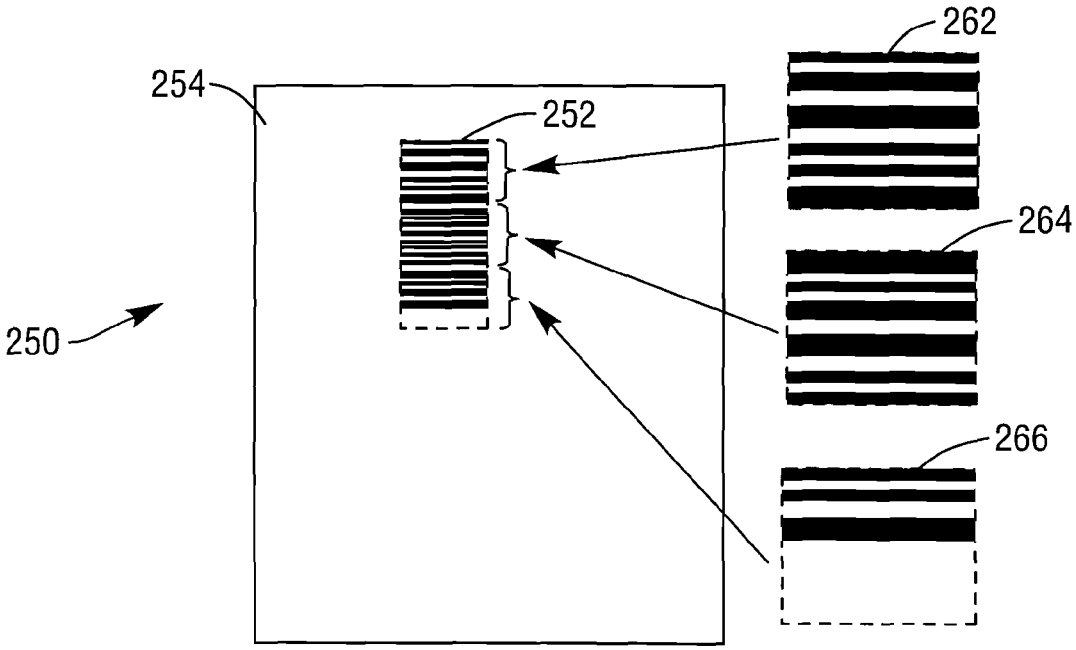
FIG. 4

PRINTING SECURITY FEATURES

The present invention relates to printing security features for use in tagging items.

BACKGROUND

Security features are used to reduce or prevent counterfeiting of items. These items may have a high intrinsic value, such as banknotes, or they may be critical parts in other items, such as brake pads in airplanes. By tagging an item with a security feature, the authenticity of the item can subsequently be confirmed by validating that the security feature is genuine.

One disadvantage of conventional security features is that counterfeiters can spend a large amount of time and money to replicate a particular security feature, and, when perfected, can then use the replicated security feature on an unlimited number of counterfeited items. When this occurs, the owner of the items may either change the security feature or add more security features, but neither of these actions can safeguard items that have already been issued with the now compromised security feature. This is a fundamental problem with even the most advanced security feature.

Unique security features could be created, for example, using variable data printing (VDP). However, VDP typically requires a digital printing press. For some applications, a huge number of different security features are required, for example, if a unique security feature was needed for each bottle of a certain brand of pain killer, or for each twenty dollar banknote. This is problematic for VDP because it is not currently economically-viable to produce a large number of security features in high volumes (for example, a million security features) and at high speeds (for example, one thousand security features per minute).

SUMMARY

According to a first aspect of the present invention there is provided a printing machine for printing security features onto a web, the machine comprising: a first printing cylinder defining a first circumference and carrying a first number (m) of rows of first image elements, each adjacent row of first image elements having a first circumferential separation; a second printing cylinder defining a second circumference, different to the first circumference, and carrying a second number (n) of rows of second image elements, different to the first number (m) of rows, where each adjacent row of second image elements has the same first circumferential separation as adjacent rows of first image elements; whereby the printing cylinders are operable to print the first and second image elements in registration on a web so that composite security features are created on the web from the first and second image elements.

As used herein, a composite security feature is a feature composed of a plurality of security feature elements. A composite security feature may be formed by concatenating image elements, by layering image elements, or both.

The web may comprise paper, cotton (rag-based), a synthetic stock (polypropylene, polyester, polystyrene, or the like) or any other convenient material.

Each row of first image elements on the first cylinder may be different to all other rows on the first cylinder, and each row of second image elements on the second cylinder may be different to all other rows on the second cylinder, so that composite security features are created on the web having a repeat row that does not occur more frequently than once in every fourth number (z) of rows, where the fourth number (z) may be as large as, or the same order of magnitude as, the first number (m) times the second number (n), although this depends on the actual values of the first number (m) and second number (n) selected. The values of the first number (m) and the second number (n) may be selected to ensure that the fourth number is as large as possible.

The printing machine may further comprise a third printing cylinder defining a third circumference, different to the first circumference and the second circumference, and carrying a third number (p) of rows of third image elements, different to the first number (m) of rows and different to the second number (n) of rows, where each adjacent row of third image elements has the same first circumferential separation as adjacent rows of first image elements and as adjacent rows of second image elements, so that a repeat row does not occur more frequently than once in every fifth number (q) of rows, where the fifth number (q) may be as large, or the same order of magnitude, as the first number (m) times the second number (n) times the third number (p).

Each cylinder may provide a registration mark (such as a cross, a circle, a plus mark, or the like) for each row of image elements, so that the printing machine can be adjusted (manually or automatically) to maintain the image elements in correct alignment so that a correctly aligned composite image is created.

The printing machine may print on a web provided as a roll, a sheet, or in any other convenient form.

The printing machine may be an offset printing machine, a rotary printing machine, a lithographic printing machine, a flexographic printing machine, a gravure printing machine, a screen printing machine, or the like.

According to a second aspect of the present invention there is provided a process for printing composite security features for tagging items, the process comprising: providing a plurality of printing cylinders, the cylinders having different diameters, and each having an array of image elements disposed and arranged thereon so that each cylinder provides a different part of a composite security feature; and printing a sheet using the plurality of cylinders to create rows of composite security features comprising image elements of the first cylinder and image elements of the second cylinder.

Where each row on a cylinder is different to all other rows on that cylinder, this has the advantage of further increasing the number of rows of composite security features that can be printed before a row of composite security features is repeated.

The process may include the further step of sensing a registration mark associated with each row of image elements and modifying transport of the web to ensure that the plurality of cylinders print in registration with the registration mark.

The process may comprise the further step of cutting the sheet lengthwise into multiple single-width sheets, each single-width sheet having one column and multiple rows.

Each single-width sheet may be further cut into individual lengths, where each individual length is shorter than the distance between repeat composite security features. The individual lengths may be wound as rolls. This has the advantage that each individual length contains no repeats; that is, only unique composite security features are provided on an individual length. The individual lengths may be more than one composite security feature shorter than the distance between repeat rows. This would ensure that when a second roll is selected at random to continue after a first roll, it is not possible to predict what composite security feature will appear first on the second roll. This is particularly important where the composite security features will be applied in succession to items that are serialized.

The composite security features may be applied individually to an item marked with a serialized code, such as a 2D barcode including a unique serial number. A database may be provided to record the association between the particular composite security feature applied to an item, and the particular unique serial number of that item.

By virtue of this aspect of the invention, it is possible to use static printing methods to produce a continuous sheet of composite security features, where the composite security features repeat much less frequently than if cylinders of equal size were used in the printing process.

Each cylinder may print onto the same spatial location as the other cylinders, so that each composite security feature is an image constructed from multiple layers on the same portion of a sheet (referred to as a layered security feature). Alternatively, each cylinder may print onto a slightly different spatial location as the other cylinders, so that each composite security feature comprises adjacent fields, each field printed by a different cylinder (referred to as a concatenated security feature). In some embodiments, there may be a combination of these two, so that for each composite security feature, some cylinders print on the same spatial location, whereas other cylinders print on a different spatial location, all within the same composite security feature (referred to as a layered, concatenated security feature).

The security feature may comprise a photochromic dye and/or pigment. Photochromic dyes and pigments can be used to provide an invisible barcode that becomes temporarily visible when exposed to UV light. The security feature can be exposed to UV light and the resulting photochromic barcode can then be read by a barcode scanner module. The UV light and the barcode scanning module may be provided in a feature reader. The same feature reader may read both a conventional spatial code (such as a 2D barcode) and a security feature (such as a photochromic barcode).

It will now be appreciated that a system may be provided having multiple different security features of the same type, only one of these security features being applied to each item. Identical items can be distinguished automatically because each item may have a unique code (stored as part of the information within a 2D barcode), which can be used as an index to access a database. The database stores details of the particular security feature expected on any given item, so the correct security feature for a particular item (not merely one of the security features used on that type of item) must be provided by a counterfeiter for a counterfeit item to be authenticated. This overcomes the problem of a counterfeiter being able to counterfeit items without restriction if the security feature is compromised. Even if all of the security features are compromised, the counterfeiter must still discover, on an item by item basis, which one of these security features is used on each particular item.

According to a third aspect of the present invention there is provided a composite security feature produced by the process of the second aspect of the invention.

According to a fourth aspect of the invention there is provided a method of tagging an item with a security feature, the method comprising: selecting one of a plurality of different security features from a common type of security feature; applying the selected security feature to an item to create a tagged item; identifying a code associated with the tagged item; and associating the identified code with the selected security feature in an authentication database to ensure that the tagged item is only authenticated if the identified code matches the selected security feature.

Identifying a code associated with the item to be tagged may be performed by reading a spatial code, such as a barcode, associated with the item. The spatial code may be fixed to the item or may subsequently be applied to the item. The code may be read by a combined reader that is capable of reading both the code and the security feature.

The code may be printed on top of the security feature. Both the code and the security feature may be disposed on a label that can be attached to the item.

The code associated with an item to be tagged may comprise all or part (for example, a serial number) of a spatial code.

This aspect of the invention is particularly advantageous where identical items have different spatial codes applied to them. For example, some manufacturers apply 2D barcodes to their products, where the 2D barcode includes a unique serial number for each product. 2D barcodes can store thousands of characters, which is much more information than conventional UPC barcodes can store, so identical components (for example, processors) from the same manufacturer can have slightly different 2D barcodes.

It will be appreciated that multiple different security features may all be of a common type. As a simple example, a type of security feature may be a geometric shape, and individual security features of this type may be a circle, a square, a triangle, and the like. Thus, the security features (the individual shapes) are all different, but they are all instances of the same type of security feature (a geometric shape). Where the type of security feature is a luminophore, one security feature may have one luminescence spectrum (for example, peaks at various wavelengths, various luminescence decay times at various wavelengths, and the like) while another security feature may have a different luminescence spectrum (for example, peaks at different wavelengths, differing luminescence decay times at the same or different wavelengths, and the like), and so on. Each of these security features being an instance of the luminophore type (or class) of security feature.

As used herein a "luminophore" is a luminescing substance that may be in the form of a pigment, or a fluid having luminescent properties.

Where a security feature is designed to be machine-readable, different security features of the same type (different security feature instances of the same security feature class) are preferably readable by the same machine.

The security feature may be overt or covert. The security feature may be human readable, machine readable, or both.

Selecting one of a plurality of different security features may be implemented by selecting from a prepared batch of different security features of the same type (or class).

The method may include the further step of providing security features as labels on a holder, such as a roll or sheet. For example, there may be a roll or sheet of labels, each label having a security feature. Not every security feature needs to be different to all other security features of that type; for example, every nth label may be identical, so that there may only be n different security features of that type. For example, the type of security feature may be a luminophore, and there may be a hundred different security features, each with a unique luminescence signature. Thus, a sheet of labels may have multiple identical security features on the sheet. The sheet may be cut into multiple sheets, each with unique security features, prior to delivery to distributors, customers, or the like.

Where labels are used, the labels may be transparent to allow the labels to be affixed on top of, and in registration with, the code. Where the security feature is invisible to the human eye (a covert feature), and the code is visible to the human eye, this allows an operator of a security feature reader to locate the security feature by locating the code.

Applying the selected security feature to the item to create a tagged item may be implemented by removing the selected security feature from the holder and adhering the label to the item to be tagged. Applying the selected security feature may be implemented robotically or by a human operator.

A label may be releasably mounted on a backing sheet or may be applied by heat treatment, chemical treatment, or the like.

The label may be coated on an underside with pressure-sensitive adhesive. The pressure-sensitive adhesive may be transparent. The label may be tamper evident to indicate if an attempt has been made to remove the label once it has been adhered to the item to be tagged. The label may include frangible portions that tear if an attempt is made to remove the label from the item to be tagged, thereby rendering the label useless for subsequent use.

Associating the identified code with the selected security feature in an authentication database may comprise communicating details of the security feature and details of the code to a remote data management system. This may be performed by a security feature reader. The remote data management system may create an entry for that item using the code as an index for that entry.

Associating the identified code with the selected security feature may further comprise reading both the code and the security feature using the security feature reader.

The security feature reader may include a barcode reader (such as an imager) and a security feature reader.

According to a fifth aspect of the present invention there is provided a printer for printing security features onto a web, the printer comprising: a first printing cylinder defining a first circumference and carrying a first number (m) of rows of first image elements, each adjacent row of first image elements having a first circumferential separation so that there is a constant repeat distance (r) between corresponding points of adjacent rows of first image elements; and a second printing cylinder defining a second circumference and carrying a second number (n) of rows of second image elements, different to the first number (m) of rows, where the circumference of the second printing cylinder differs from the circumference of the first printing cylinder by an amount equal to a positive integer number multiplied by the constant repeat distance (r).

It should be appreciated that the repeat distance (r) is the circumferential distance from a point on a first image element on one row to a corresponding point on a first image element on an adjacent row.

Multiple printing cylinders may be used, each with a circumference differing from the other printing cylinders by a positive integer number multiplied by the constant repeat distance (r).

These and other aspects of the invention will now be described, by way of example, with reference to the accompanying drawings.

BRIEF DESCRIPTION OF THE DRAWINGS

In the accompanying drawings:

FIG. 3 is a schematic diagram of a removable self-adhesive label including a security feature printed by the printing machine of FIG. 1; and FIG. 4 is a schematic diagram of another security feature printed on a web by a printing machine according to another embodiment of the present invention.

DETAILED DESCRIPTION

Figure 1:
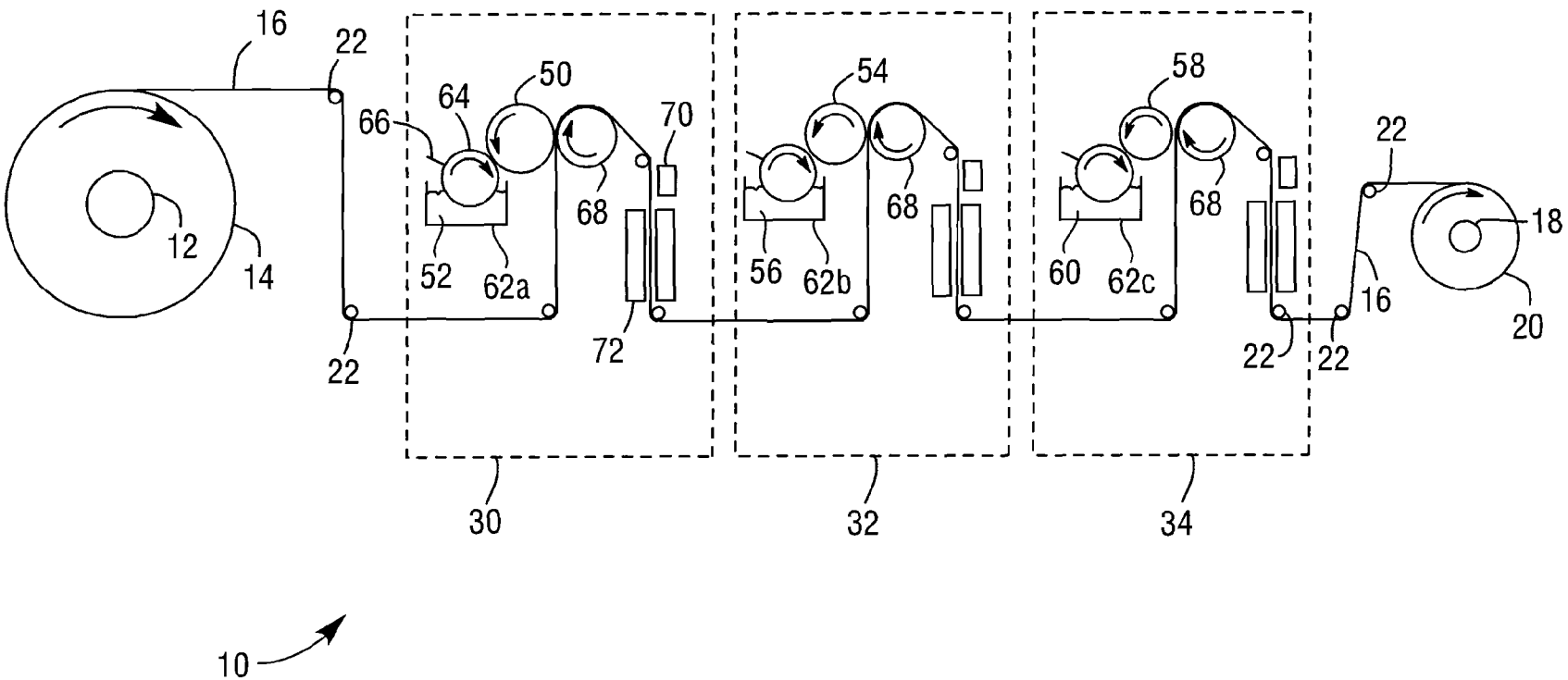
FIG. 1 is a schematic diagram of a printing machine for printing security features onto a web according to one embodiment of the present invention.

Reference is first made to FIG. 1, which is a cross-sectional schematic diagram of a printing machine 10 for printing composite security features onto a web according to one embodiment of the present invention. In FIG. 1, the printing machine 10 is a flexographic printing press for roll to roll printing.

The flexographic press 10 comprises a mounting shaft 12 for a removable starting roll (an unwind roll) 14 on which a blank (that is, ready for printing) web 16 is wound, and a mounting shaft 18 for a removable completion roll (a rewind roll) 20 on which the web 16 is wound when composite security features have been printed thereon. The web 16 is maintained in tension by the starting and completion rolls 14,20, and guided through the press 10 by various guide rollers 22 disposed between the starting and completion rolls 14,20.

The press 10 further comprises a plurality of printing stations (also referred to as towers) 30,32,34 (three of which are illustrated in this embodiment). Each of these printing stations 30,32,34 has some common components and some unique components. Each common component will be referenced herein by a single reference numeral (for example, reservoir 62), although FIG. 1 shows the letters a, b, and c appended to that single reference numeral for each printing station 30,32,34 respectively (for example, reservoir 62*a* in printing station 30, reservoir 62*b* in printing station 32, and reservoir 62*c* in printing station 34). The unique components will each be given a different reference numeral.

The first printing station 30 includes a first printing cylinder (also referred to as a plate cylinder) 50 having a circumference of 56 cm (the first circumference) and a first type of printing ink 52 in the form of an invisible, ultra-violet, fluorescent ink that fluoresces in the red region of the electromagnetic spectrum.

The second printing station 32 includes a second printing cylinder (also referred to as a plate cylinder) 54 having a circumference of 52 cm (the second circumference) and a second type of printing ink 56 in the form of an invisible, ultra-violet, fluorescent ink that fluoresces in the blue region of the electromagnetic spectrum.

The third printing station 34 includes a third printing cylinder (also referred to as a plate cylinder) 58 having a circumference of 48 cm (the third circumference) and a third type of printing ink 60 in the form of an invisible, ultra-violet, fluorescent ink that fluoresces in the green region of the electromagnetic spectrum.

Each of the printing stations 30,32,34 has the following common components: a reservoir 62 for holding ink 52,56, or 60; an anilox roller 64; and a doctor blade 66 mounted in spaced relation to the anilox roller 64 to ensure a consistent thickness of ink is applied to the anilox roller 64.

The unique components of each printing station 30,32,34 include the actual ink 52,56,60 used in each printing station 30,32,34. In this embodiment, the inks 52,56,60 are all UV-curable inks.

Each of the printing stations 30,32,34 also has the following common components: an impression cylinder 68 for supporting a portion of the web 16 to be printed on by the printing cylinders 50,54,58; an ultra-violet light source 70 for curing the inks 52,56,60; and a drying oven 72 (not used in this embodiment) for drying any water-based inks that may be used.

As will be described in more detail below, each printing station 30,32,34 uses its ink to print a layer of images on the web 16, so that when the web 16 has passed through all of the printing stations 30,32,34 composite security features are created comprising each of the layers.

Figure 2A:
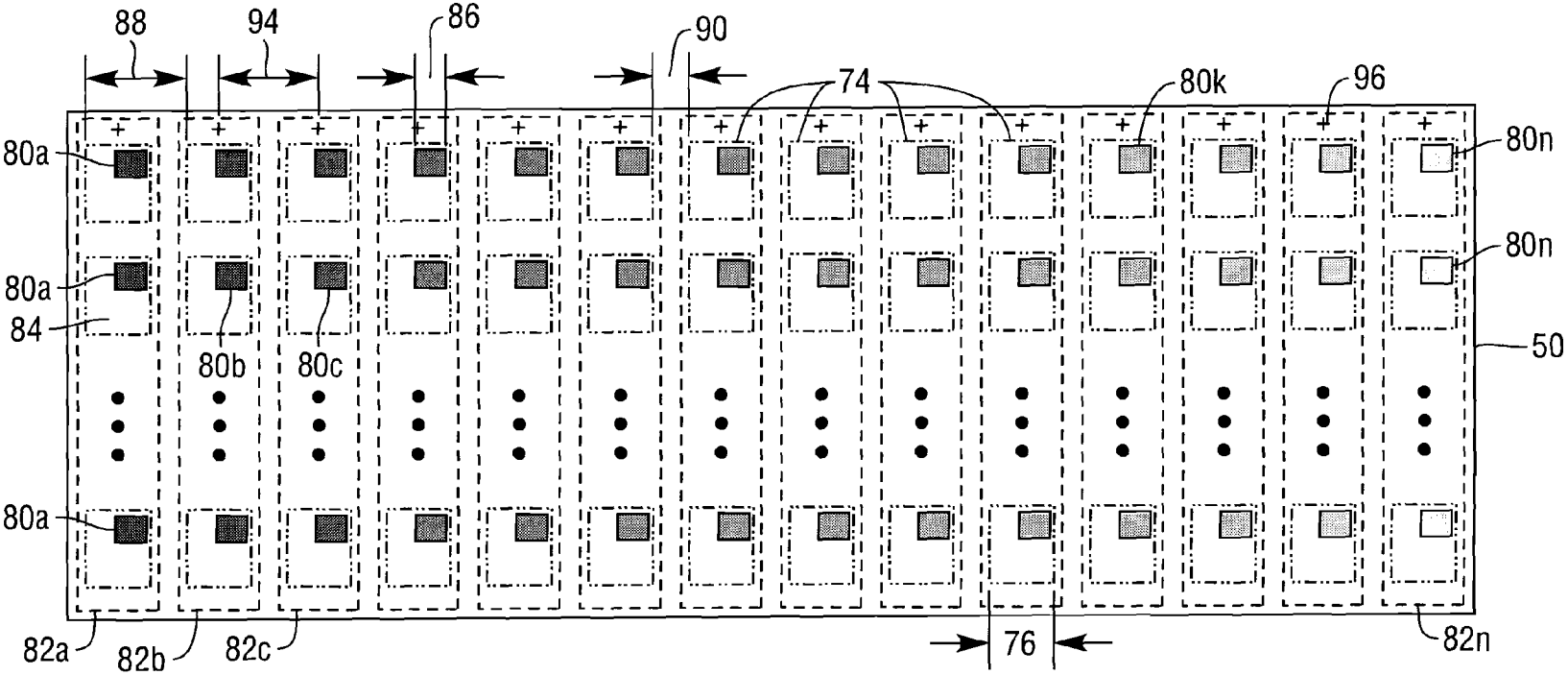
FIG. 2*a* illustrates image elements disposed on a first part (the circumference of a first printing cylinder) of the printing machine of FIG. 1.
Figure 2B:
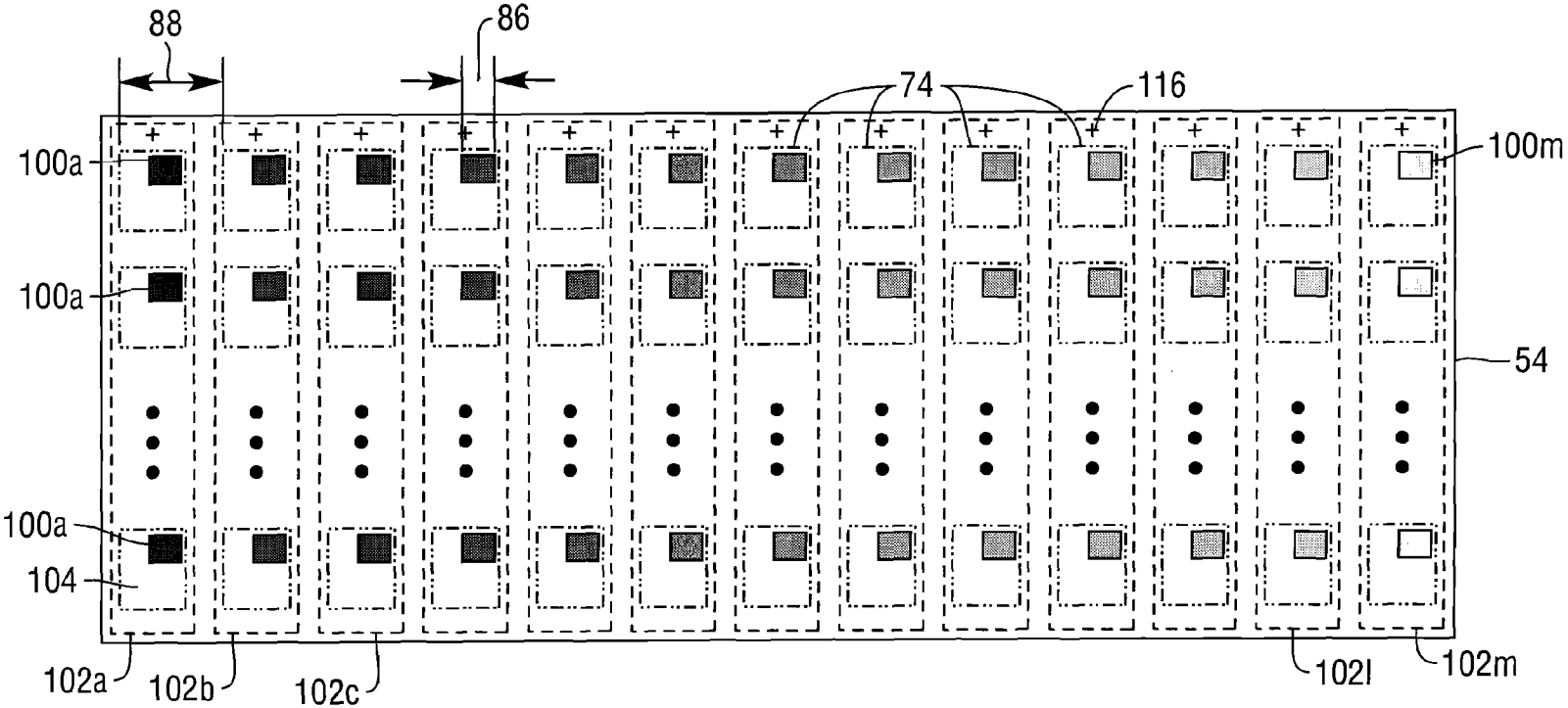
FIG. 2*b* illustrates image elements disposed on a second part (the circumference of a second printing cylinder) of the printing machine of FIG. 1.
Figure 2C:
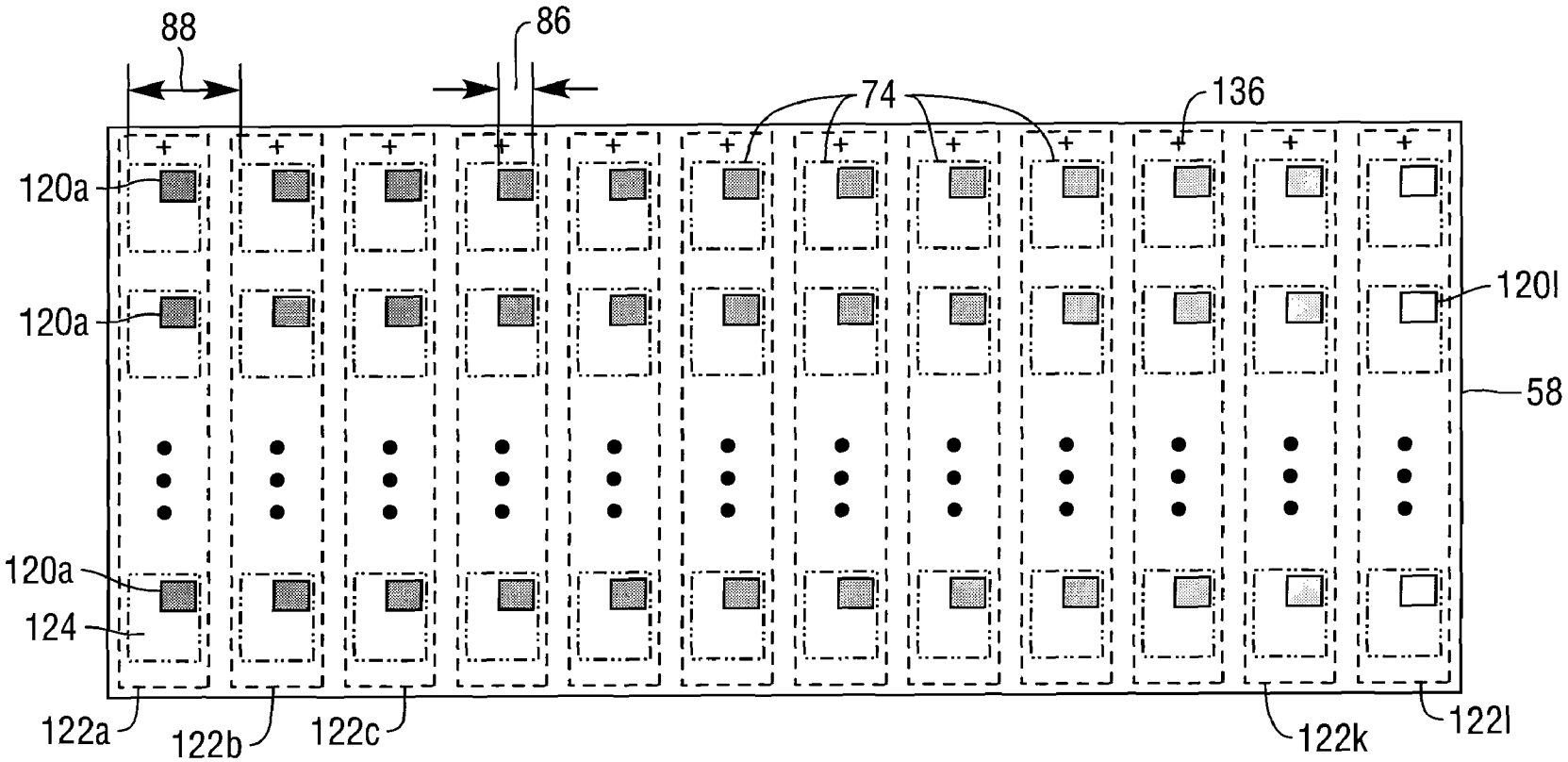
FIG. 2*c* illustrates image elements disposed on a third part (the circumference of a third printing cylinder) of the printing machine of FIG. 1.

Reference is now also made to FIGS. 2*a*, 2*b*, and 2*c*, which illustrate security image elements disposed on the circumference of each of the first, second, and third printing cylinders 50,54,58 respectively, where the circumference is illustrated in a linear manner. FIGS. 2*a* through 2*c* illustrate label areas 74 (shown in chain line), which indicate where die cuts may be formed on the web 16 subsequent to printing by the flexographic press 10. This may be achieved by passing the web 16 through an in-line die-cutting machine to create integrated, self-adhesive, labels, so that the labels can be individually removed from the web 16 and applied.

The first printing cylinder 50 includes an array of image elements 80 comprising fourteen equidistant rows 82 (individually labelled 82*a* through 82*n*) spaced around the entire circumference (56 cm) of the cylinder 50. The rows 82 are illustrated as approximately the same width as the label areas 74. The fourteen equidistant rows (82*a* . . . *n*) are disposed as multiple columns (only three of which are shown) extending axially across the cylinder 50. Each row contains identical image elements (for example, image elements 80*a* on row 82*a*) surrounded by a frame 84, but the image elements on each row (for example 82*a*) differ from those of all of the other rows (for example 82*b* to 82*n*) on the first printing cylinder 50. This ensures that the distance between repeat rows 82 equals the circumference of the first printing cylinder 50.

In this embodiment, the difference between rows of image elements 80 is based on the amount of ink 52 deposited on the web 16 by each image element 80. As shown in FIG. 2*a*, those rows 82 of image elements 80 to the left side of FIG. 2*a* have a higher saturation of ink 52 than those on the right side. FIG. 2*a* illustrates a generally linear progression of ink saturation from 100% (at the far left) to less than 10% (at the far right). The desired amount of saturation of ink 52 for any given row 82 may be achieved by tailoring the ratio of the amount of remaining material to the amount of removed material for each row 82 on the printing cylinder 50. The higher the ratio of remaining material to removed material for any given row 82, the greater the saturation of ink 52 that will be provided by that row 82. Thus, the ratio of remaining material to removed material for image elements (for example, 80*a*) on each row (for example, 82*a*) will differ from the ratio of remaining material to removed material for image elements (for example, 80*b* to 80*n*) on all other rows (for example, 82*b* to 82*n*) of that cylinder 50.

Each image element 80 has a width (illustrated by arrows 86) of 1 cm. The width 76 of the label area 74 is 3 cm. The distance between corresponding points of adjacent rows (for example, row 82*b* and row 82*c*) is 4 cm (illustrated by arrows 88), so that there is a gap between adjacent rows (for example, row 82*b* and row 82*c*) of 1 cm (illustrated by arrows 90).

In this embodiment the frame 84 is blank. In each label area 74, the image element 80 and the frame 84 are disposed in identical spaced relation, so that the distance between corresponding points of adjacent image elements 80 (as illustrated by, for example, distance 94) equals the distance between corresponding points of adjacent frames 84. In this embodiment, the image element 80 includes the fluorescent red printing ink 52, shown in grayscale in FIG. 2*a*.

Each row 82 of image elements includes a registration mark 96 (in the form of a cross in this embodiment) equally spaced along the circumference of the first printing cylinder 50.

Those of skill in the art will now realise that the first printing cylinder 50 includes image elements 80 equally spaced along its circumference so that the first printing cylinder 50 can print equally spaced image elements 80 on a continuous (in practice this means very long) web 16 as it passes between the first printing cylinder 50 and its associated impression cylinder 68.

Reference will now be made to FIG. 2*b*, which illustrates features of the second printing cylinder 54 in a linear manner.

The second printing cylinder 54 is similar in many respects to the first printing cylinder 50, but there are some significant differences. The primary difference is that the circumference of the second printing cylinder 54 is 52 cm, which is 4 cm less than that of the first printing cylinder 50. For clarity, the label areas 74 are also shown on the second printing cylinder 54, although they do not appear as relief features on that cylinder 54 (or on either of the other printing cylinders 50,58).

The second printing cylinder 54 also includes an array of image elements 100, but this array comprises only thirteen rows (labelled 102*a* through 102*m*) and multiple columns (only three of which are shown). Each row 102 contains identical image elements (for example row 102*a* contains image elements 100*a*), but the image elements on each row (for example 102*a*) differ from those of all of the other rows (for example 102*b* to 102*m*) on the second printing cylinder 54. This ensures that the distance between repeat rows equals the circumference of the second printing cylinder 54.

For the second printing cylinder 54, each image element 100 has identical width 86 and spacing 88 to the image elements 80 on the first printing cylinder 50.

Each label area 74 on the second printing cylinder 54 comprises the image element 100 surrounded by a frame 104. In each label area 74 on the second printing cylinder 54, the image element 100 and the frame 104 are disposed in identical spaced relation, so that the distance between corresponding points of adjacent image elements 100 (as illustrated by, for example, spacing 88) equals the distance between corresponding points of adjacent frames 104. In this embodiment, the image element 100 includes the fluorescent blue printing ink 56, shown in grayscale in FIG. 2*b*.

In each label area 74 on the second printing cylinder 54, the image element 100 and the frame 104 are disposed in identical spaced relation. In this embodiment, the relative spacing between the image element 100 and the frame 104 for the second printing cylinder 54 is identical to the corresponding relative spacing between the image element 80 and the frame 84 for the first printing cylinder 50.

Each row 102 of image elements also includes a registration mark 116 (in the form of a cross in this embodiment) equally spaced along the circumference of the second printing cylinder 54.

Those of skill in the art will now realise that the second printing cylinder 54 includes image elements 100 equally spaced along its circumference. Furthermore, these image elements 100 have identical size and spacing to the image elements 80 on the first printing cylinder 50. This means that, provided the first and second printing cylinders 50,54 are correctly spaced and aligned (re. in proper registration), the first and second printing cylinders 50,54 will print a series of composite images, each composite image comprising an image element 100 superimposed on an image element 80. Because each row 82,102 is different, and there are a different number of rows on the first and second printing cylinders 50,54, a composite image will only be repeated every one hundred and eighty two rows (thirteen times fourteen).

The third printing cylinder 58 is similar in many respects to the first and second printing cylinders 50,54. The primary difference is that the circumference of the third printing cylinder 58 is 48 cm, which is 4 cm less than that of the second printing cylinder 54, and 8 cm less than that of the first printing cylinder 50. For clarity, the label areas 74 are also shown on the third printing cylinder 58, although they do not appear as relief features on that cylinder 58 (or on either of the other printing cylinders 50,54).

The third printing cylinder 58 also includes an array of image elements 120, but this array comprises only twelve rows (labelled 122*a* through 122*l*) and multiple columns (only three of which are shown). Each row 122 contains identical image elements (for example, row 122*a* contains image elements 120*a*), but the image elements on each row (for example 122*a*) differ from those of all of the other rows (for example 122*b* to 122*n*) on the third printing cylinder 58. This ensures that the distance between repeat rows equals the circumference of the third printing cylinder 58.

For the third printing cylinder 58, each image element 120 has identical width 86 and spacing 88 to the image elements 80 and 100 on the first and second printing cylinders 50,54.

Each label area 74 on the third printing cylinder 54 comprises the image element 120 surrounded by a frame 124. In each label area 74 on the third printing cylinder 58, the image element 120 and the frame 124 are disposed in identical spaced relation, so that the distance between corresponding points of adjacent image elements 120 (as illustrated by, for example, spacing 88) equals the distance between corresponding points of adjacent frames 124. In this embodiment, the image element 120 includes the fluorescent green printing ink 60, shown in grayscale in FIG. 2*c*.

In this embodiment, the relative spacing between the image element 120 and the frame 124 for the third printing cylinder 58 is identical to the corresponding relative spacing between the image element 100 and the frame 104 for the second printing cylinder 54, and also to the corresponding relative spacing between the image element 80 and the frame 84 for the first printing cylinder 50. This allows the three image elements 80,100,120 to print on the same portion of the web 16.

Each row 122 of image elements also includes a registration mark 136 (in the form of a cross in this embodiment) equally spaced along the circumference of the third printing cylinder 58.

Those of skill in the art will now realise that the third printing cylinder 58 includes image elements 120 equally spaced along its circumference. Furthermore, these image elements 120 have identical size and spacing to the image elements 80,100 on the first and second printing cylinders 50,54. This means that, provided the first, second, and third printing cylinders 50,54,58 are correctly spaced and aligned (re. in proper registration), the printing cylinders 50,54,58 will print a series of composite images, each composite image comprising an image element 120 from the third cylinder 58 superimposed on an image element 100 from the second cylinder 54 superimposed on an image element 80 from the first cylinder 50. Because each row 82,102,122 is different, and there are a different number of rows on each of the three printing cylinders 50,54,58, a composite image will only be repeated after approximately two thousand rows.

The registration marks 96,116,136 enable minor adjustments to be made to the flexographic press 10 (either manually or automatically) to ensure that the composite images are maintained in registration.

A conventional die-cutting machine (not shown) may be provided in-line with the flexographic press 10 to form die-cuts on the printed web 16 at areas corresponding to the label areas 74 to provide removable self-adhesive labels 150 (FIG. 3).

Reference will now also be made to FIG. 3, which is a schematic diagram of one of the removable self-adhesive labels 150 created on the printed web 16. The label 150 includes a composite security feature 152 (which is a composite of three image elements 80,100,120) created on the web 16 by the flexographic press 10, and a frame area 154 corresponding to frames 84,104,124 using respective fluorescent printing inks 52,56,60. When illuminated by UV radiation, the composite security feature 152 luminesces, emitting radiation with frequencies and intensities corresponding to the proportion of each ink/color (red, blue, and green) present in the composite security feature 152.

Prior to removing the self-adhesive labels 150 therefrom, the printed web 16 includes a very large number of rows of composite security features 152, where the composite security features 152 in each row are identical to all other composite security features in that row but different to the composite security features 152 in neighbouring rows. The number of rows between rows having identical composite security features 152 (referred to as repeat rows) is two thousand one hundred and eighty four rows (twelve times thirteen times fourteen).

The printed web 16 can be cut into individual columns by a cutting machine (not shown), and each column can be cut and wound onto a single-width roll. The radius (that is, the unwound length) of the single-width roll may be selected so that there are one thousand security features 150 on the single-width roll. The single-width roll may then be mounted on a robotic label placement device (not shown) that automatically removes a self-adhesive label 150 and applies it to a device to be tagged with a composite security feature 152.

By providing single-width rolls having fewer composite security features 152 than the number of rows between repeat rows, it is virtually impossible to predict which composite security feature on one single-width roll corresponds to which security feature on another single-width roll.

The above embodiment discloses composite security features 152 formed from multiple layers having the same spatial location (a layered security feature). Another embodiment will now be described where the security feature comprises adjacent fields, each field printed by a different cylinder (a concatenated security feature).

Reference is now made to FIG. 4, which is a schematic diagram of another label 250 including a composite security feature 252 printed on a web by a printing machine according to another embodiment of the present invention. The label 250 also includes a frame 254 around the composite security feature 252.

The composite security feature 252 comprises a one-dimensional (1D) barcode having three fields 262,264,266, where each field is printed by a different printing cylinder. The three fields are spatially aligned in a linear manner so that the combination of the three fields 262,264,266 can be read as a single barcode (a concatenated security feature). To achieve this, the first and second fields 262,264 have fixed lengths; whereas the third field 266 can have a variable length. This is illustrated in FIG. 4 by a dotted line around each field, where the barcode fills the first two fields 262,264, but not the third field 266.

Any of a variety of barcode symbologies could be used, provided there is no requirement for a checksum or other check digit. In this embodiment the barcode symbology used is called Code 39. Code 39 is described in "The Bar Code Book" by Roger C. Palmer, Helmers Publishing, Inc., Peterborough, N.H., 1991, page 33. Code 39 uses a unique arrangement of six narrow and three wide elements for each character represented by that symbology. Code 39 has a fixed code to indicate the start of a barcode and a fixed code to indicate the end of a barcode.

In a similar manner to the FIG. 1 embodiment, the printing machine that created the security feature 252 has three cylinders having diameters of 39 cm, 36 cm, and 33 cm respectively. The respective fields are provided on each cylinder as equidistant rows, with a distance of 3 cm between corresponding points on adjacent rows. This allows the first printing cylinder to accommodate thirteen rows of fields, the second printing cylinder to accommodate twelve rows of fields, and the third printing cylinder to accommodate eleven rows of fields. The first printing cylinder prints the first field 262, the second printing cylinder prints the second field 264, and the third printing cylinder prints the third field 266. Table 1 below illustrates the text equivalent of the barcode portions printed in each field.

TABLE 1 the text equivalent of the barcode portions printed in each field

| Row number on each printing cylinder | Cylinder 1 (first field) | Cylinder 2 (second field) | Cylinder 3 (third field) |
|---|---|---|---|
| 1 | PRIME A | 11 | ZX |
| 2 | PRIME B | 22 | VBN |
| 3 | PRIME C | 33 | AQSW |
| 4 | PRIME D | 44 | ASXDF |
| 5 | PRIME E | 55 | QAQ1D |
| 6 | PRIME F | 66 | QWE |
| 7 | PRIME G | 77 | TYU |
| 8 | PRIME H | 88 | JOE |
| 9 | PRIME I | 99 | JOHN |
| 10 | PRIME J | AA | PETER |
| 11 | PRIME K | BB | RORY |
| 12 | PRIME L | CC | |
| 13 | PRIME M | | |

The first field 262 comprises eight characters, namely: a start character, five characters to spell PRIME, a space character, and then an alphabetic character (selected from A through M).

The second field 264 comprises two alphanumeric characters.

The third field 266 comprises a variable length field. The third field always includes the stop character in addition to the characters shown in the fourth column of Table 1 above. In this embodiment, the third field 266 may have as few as three characters (see row number one in Table 1) or as many as six alphanumeric characters (see rows number four, five, and ten in Table 1).

The values of the first fifteen barcodes printed using the three cylinders described above are shown in Table 2. It is believed that the barcode values begin repeating after 1716 (thirteen times twelve times eleven) barcodes have been printed; that is, the $1717^{th}$ barcode printed has the value "PRIME A11ZX".

TABLE 2 the values of the first fifteen barcodes printed using the three cylinders described in Table 1

| Composite security feature number | Text equivalent of barcode printed |
|---|---|
| 1 | PRIME A11ZX |
| 2 | PRIME B22VBN |
| 3 | PRIME C33AQSW |
| 4 | PRIME D44ASXDF |
| 5 | PRIME E55QAQ1D |
| 6 | PRIME F66QWE |
| 7 | PRIME G77TYU |
| 8 | PRIME H88JOE |
| 9 | PRIME I99JOHN |
| 10 | PRIME JAAPETER |
| 11 | PRIME KBBRORY |
| 12 | PRIME LCCZX |
| 13 | PRIME M11VBN |
| 14 | PRIME A22AQSW |
| 15 | PRIME B33ASXDF |
| . | |
| . | |
| . | |

It will now be appreciated that each of these embodiments (the layered security feature and the concatenated security feature) has the advantage that a large number of unique codes can be printed using a static printing method (that is, using printing cylinders having preset images or text).

Various modifications may be made to the above described embodiments within the scope of the present invention. In other embodiments, the security feature batch may be implemented as one or more sheets of labels. The security feature batch may be mounted in a machine that automatically dispenses labels on request.

In other embodiments, the labels 150, 250 may be larger or smaller than shown.

In other embodiments, the web may be pre-printed with information prior to loading onto the printing machine.

In other embodiments, each image element may completely fill the label so that there is no frame.

In other embodiments, the frame may include overt or covert machine readable information, such as a barcode.

In other embodiments, the image elements on each row may not be located in identical spaced relation to the image elements on other rows of that printing cylinder, so that the distance between adjacent image elements may vary along the circumference of the printing cylinder, even though the distance between rows may not vary.

In other embodiments, an image element may include both a security element portion and a code, such as a spatial code.

In other embodiments, the difference between rows of image elements may be based on a parameter other than the amount of ink deposited on the web by each image element such as, for example, through the printing of differing text and/or graphic elements.

In other embodiments, the security features used may not be UV excitable (for example, they may be excited by radiation in the visible or infra-red ranges of the electromagnetic spectrum), or the security features used may not be luminescence-based, or they may not be covert security features (for example a spatial code may be used), or they may be covert but not luminescence-based (for example a spatial code printed with photochromic ink), they may not even be optical (for example, they may be ultrasonic or radio-frequency based).

In other embodiments, the security feature may be a photochromic spatial code, such as a photochromic 2D barcode.

This would allow a conventional barcode scanner to be modified by adding an LED (or other suitable excitation source) to excite the photochromic barcode prior to reading the excited barcode.

In other embodiments, the printing machine may be a lithographic, gravure, screen printing, or an intaglio press. In other embodiments, the printing machine may implement roll to sheet printing.

In other embodiments more than three printing stations or fewer than three printing stations may be provided on the printing machine.

In other embodiments, the frame area may include printing (text or graphics), an additional security feature (overt or covert), or the like.

In the above embodiment relating to a concatenated security feature, each printing cylinder printed an entire field. In other embodiments, one printing cylinder could print part of a field, and another printing cylinder could print another part of the same field. For example, where eight characters are to be printed using a barcode, the first cylinder could print the bars for the first, fifth, and seventh characters; the second cylinder could print the bars for the start, stop, second, third, and eighth characters; and the third cylinder could print the bars for the fourth and sixth characters.

In the above embodiment relating to a concatenated security feature, some of the text printed was constant for all barcodes (for example, the word "PRIME", in other embodiments no two rows may include the same information.

In the above embodiment relating to a concatenated security feature, a photochromic ink, fluorescent ink, or the like may be used to print the 1D barcode. In other embodiments, a 2D barcode may be printed as a concatenated security feature. One suitable type of 2D barcode uses a Codablock symbology, which comprises multiple rows of the Code 39 symbology.

In other embodiments, a different barcode symbology may be used, for example, Codabar or Interleaved 2 of 5.

It will be appreciated that the particular values given of the size of each printing cylinder and/or elements thereon, the number of printing cylinders, the number of rows on each printing cylinder, the number of columns on each printing cylinder, and the like, are merely illustrative of some convenient values that could be used; different values may be used instead of those provided.

In other embodiments, a layered, concatenated security feature may be provided.

In other embodiments, the printing cylinders may be used to print geometric shapes (such as rectangles, triangles, circles, and the like), each cylinder printing only one type of shape (such as a rectangle) but each row of a cylinder printing a different number of that type of shape. For example, cylinder one may only print rectangles, the first row having one rectangle per image element, the second row having two rectangles per image element, and so on; whereas, cylinder two may only print triangles, the first row having one triangle per image element, the second row having two triangles per image element, and so on. The composite security feature may be read (either by a human or a machine) by counting the number of each type of geometric shape in that composite security feature. The geometric shapes may be printed overtly or covertly.

In other embodiments, the printing cylinders may be used to print an alphanumeric text string (rather than the barcode equivalent of an alphanumeric text string). This has advantages of easy human readability.

In other embodiments, a spatial pattern of different colors may be provided, with each printing cylinder printing one color in different fields. Such a pattern could be read by a CCD imaging device of suitable resolution.

In other embodiments additional printing stations (also called towers) may be provided on the printing machine, some of which may print information that does not change from row to row. Such information may include a company name, a product name, a company logo, statutory information, or any other desired information.

What is claimed is:

1. A printing machine for printing security features onto a web, the machine comprising:

a first printing cylinder defining a first circumference and carrying a first number (m) of rows of first image elements, each adjacent row of first image elements having a first circumferential separation, wherein each row of first image elements on the first cylinder is different to all other rows on the first cylinder;

a second printing cylinder defining a second circumference, different to the first circumference, and carrying a second number (n) of rows of second image elements, different to the first number (m) of rows, where each adjacent row of second image elements has the same first circumferential separation as adjacent rows of first image elements, wherein each row of second image elements on the second cylinder is different to all other rows on the second cylinder; and a third printing cylinder defining a third circumference, different to the first circumference and the second circumference, and carrying a third number (p) of rows of third image elements, different to the first number (m) of rows and different to the second number (n) of rows, where each adjacent row of third image elements has the same first circumferential separation as adjacent rows of first image elements and as adjacent rows of second image elements, so that a repeat row does not occur more frequently than once in every fourth number (q) of rows, where the fourth number (q) is less than or equal to the first number (m) times the second number (n);

whereby the printing cylinders are operable to print the first and second image elements in registration on a web so that composite security features are created on the web from the first and second image elements.

2. A printing machine according to claim 1, wherein each cylinder provides a registration mark for each row of image elements.

3. A printing machine according to claim 1, wherein the printing machine is an offset printing machine.

* * * * *